United States Patent [19]

Ericsson

[11] Patent Number: 4,593,732

[45] Date of Patent: Jun. 10, 1986

[54] METHOD AND INSTALLATION FOR PROCESSING TREES IN A TERMINAL LANDING

[75] Inventor: Sven O. Ericsson, Fjugesta, Sweden

[73] Assignee: S O Eriksson Maskin AB, Fjugesta, Sweden

[21] Appl. No.: 616,219

[22] PCT Filed: Sep. 30, 1983

[86] PCT No.: PCT/SE83/00345

§ 371 Date: May 29, 1984

§ 102(e) Date: May 29, 1984

[87] PCT Pub. No.: WO84/01321

PCT Pub. Date: Apr. 12, 1984

[30] Foreign Application Priority Data

Sep. 30, 1982 [SE] Sweden ..... 8205593

[51] Int. Cl.[4] ..... B27L 1/00

[52] U.S. Cl. ..... 144/2 Z; 144/3 D; 144/343

[58] Field of Search ..... 144/2 Z, 3 D, 338, 343, 144/335

[56] References Cited

U.S. PATENT DOCUMENTS 4,148,344 4/1979 Critchell et al. ..... 144/3 R

FOREIGN PATENT DOCUMENTS

| | | |
|---|---|---|
| 2823087 | 11/1979 | Fed. Rep. of Germany . |
| 3037597 | 4/1982 | Fed. Rep. of Germany . |
| 57571 | 9/1978 | Finland . |
| 183662 | 5/1963 | Sweden . |
| 220078 | 4/1968 | Sweden . |
| 316894 | 11/1969 | Sweden . |
| 7704066 | 11/1978 | Sweden . |
| 414285 | 7/1980 | Sweden . |
| 511211 | 7/1976 | U.S.S.R. . |
| 620374 | 7/1978 | U.S.S.R. . |
| 647110 | 2/1979 | U.S.S.R. . |

*Primary Examiner*—Francis S. Husar
*Assistant Examiner*—Jorji M. Griffin
*Attorney, Agent, or Firm*—Hill, Van Santen, Steadman & Simpson

[57] ABSTRACT

An installation for processing unlimbed or delimbed trees in a terminal landing comprises a processing unit (14) which is movable on a track (13) running along a storage of unlimbed or delimbed trees (12). The processing unit (14) includes a loading crane (23) for taking trees from the storage (11) and feeding them, butt end foremost, into a processing assembly (24). The processing assembly (24) cuts the trees to logs which are allowed to drop onto a log receiving bed (15) having an inclined plane on which the logs are parallelized with the track (13) and caused to be uniformly directed, whereupon they are transported to a sorting installation by a horizontal conveyor (16) positioned along the lower edge of the inclined plane.

7 Claims, 4 Drawing Figures

METHOD AND INSTALLATION FOR PROCESSING TREES IN A TERMINAL LANDING

This invention relates to a method and an installation for processing trees in a terminal landing.

In modern forestry it is common practice to process felled trees in a greater or less degree in terminal landings. Thus, unlimbed trees, which may or may not be topped, are transported to a terminal landing and processed there. In any event, the processing there comprises delimbing the trees and transversely cutting the stems to logs, but other processing steps may also be carried out, such as chipping of a portion of the tree and debarking and lengthwise sawing of a different portion. The processing in the terminal landing need not comprise delimbing and thus may be carried out on stems, that is, trees which have already been delimbed. In this specification, no distinction is made between trees and stems so that the term "tree", as used in this specification, may mean both an unlimbed tree , i.e., a tree that has not been delimbed, and a delimbed tree, that is, a stem. The term "log" as used herein denotes a piece of merchantable timber resulting from the processing of a delimbed tree.

Existing off-road processors are used for delimbing felled trees and cutting them to logs at or near the felling site. Such machines are not suited for processing trees in terminal landings, where the transverse cutting must be carried out within close tolerances of length—the length of the logs should not deviate from the nominal length by more than a few centimetres—and where it must be possible to sort the logs and transport them in parallelized and unidirectionalized condition to an assortment storage.

An object of the invention is to provide a method and a system meeting the above-mentioned requirements. According to the invention, this object is achieved with the method and the installation defined in the claims.

The invention is described in greater detail below with reference to the accompanying drawings.

Figure 1:
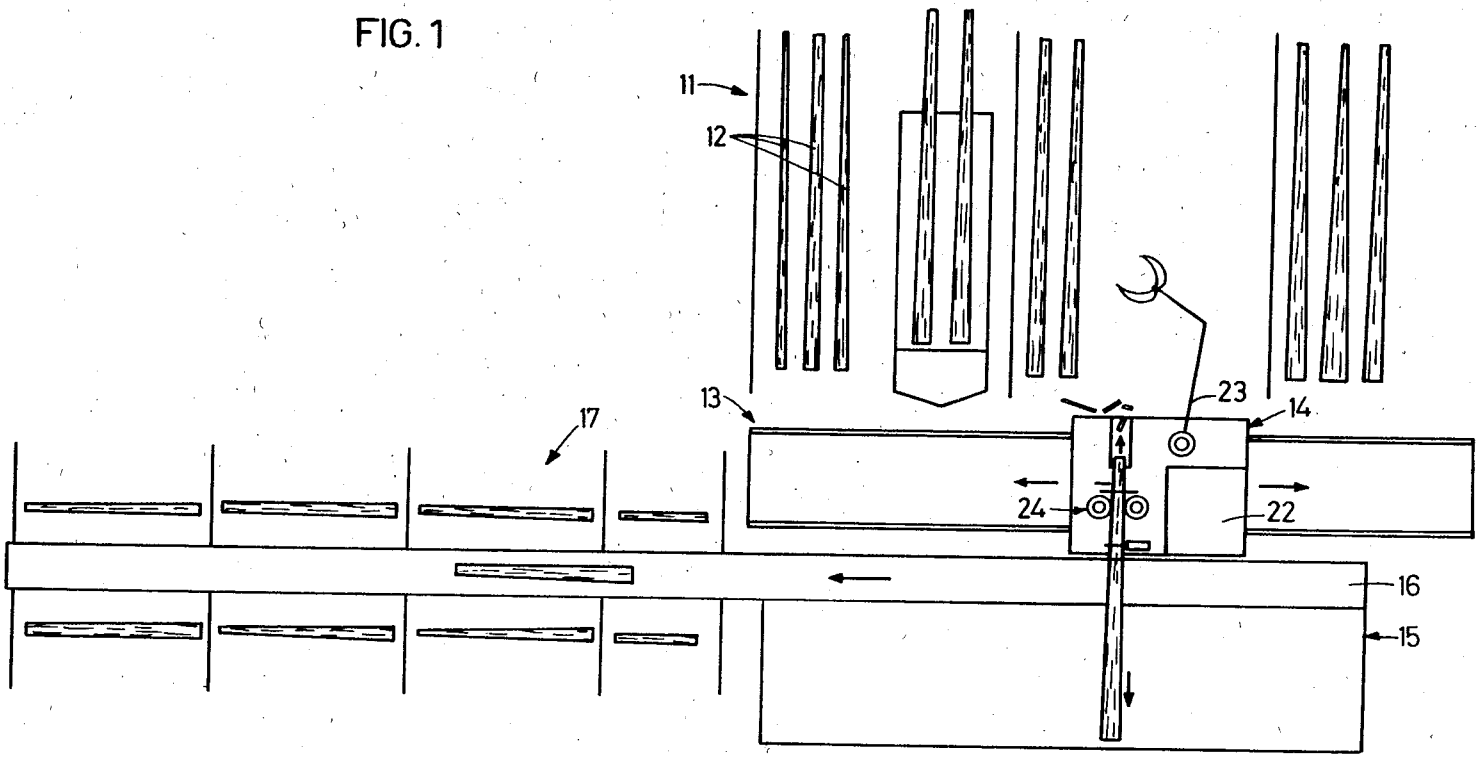
FIG. 1 is a diagrammatic plan view of a processing installation embodying the invention.

The installation diagrammatically shown in FIG. 1 comprises a storage 11 for unlimbed or delimbed trees 12 to be processed. Advantageously, the trees 12 in the storage are sorted so that trees suitable for a certain end use or a certain customer are stored separately. The trees are parallelized and advantageously unidirectionalized such that their butt ends are adjacent the track of the processing unit to be described.

Moreover, the system comprises a railway track 13 running along the storage 11 transversely of the longitudinal direction of the trees 12, and a processing unit 14 movable on wheels along the track and used for processing the trees into logs. On the side of the track 13 remote from the storage 11 there is a log receiving bed 15 which is elongated in the direction of the track and onto which the logs resulting from the processing operation drop. On its side adjacent the track, the log receiving bed 15 has a horizontal conveyor 16 forwarding the logs received by the bed to a sorting installation 17.

The track 13 is supported by a concrete foundation 19 which also forms a foundation for the log receiving bed 15 and its log conveyor 16.

The processing unit 14 is supported on the track 13 by four wheels 20, at least two of which are driven by a hydraulic motor, and comprises a substantially square horizontal platform 21. At one corner of the platform an operator's cabin 22 is provided from which an operator controls and monitors the system. Adjacent the operator's cabin a hydraulic loading crane 23 of the folding arm type is provided by means of which the operator can pick trees one by one from the storage 11 and bring them to the processing unit with the butt end foremost. Moreover, the processing unit 14 includes a processing assembly 24 carrying out the actual processing.

Figure 4:
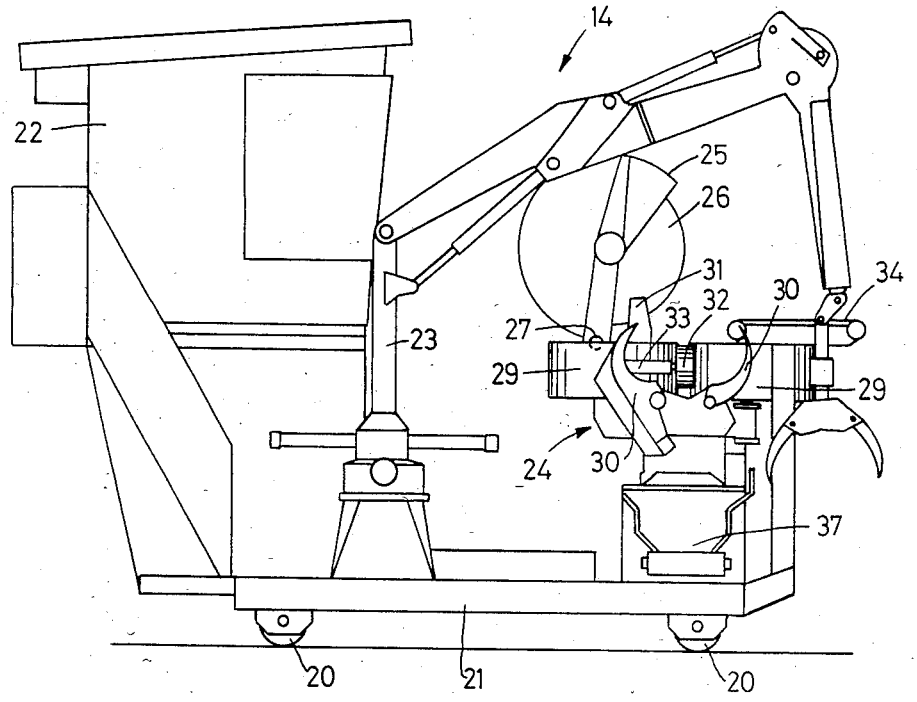
FIG. 4 is an elevational view of the processing unit shown in FIG. 3.

The processing comprises transverse cutting of delimbed trees into logs of a predetermined length selected automatically or determined from case to case by the operator. The cutting is effected by means of a cutter 25 having a circular saw blade 26 driven by a hydraulic motor. The cutter 25 is swingable about a horizontal axis 27 between the inoperative position shown in FIG. 4 and an operative position in which the circular saw blade is in the feed path of the tree which is represented in the drawings by a phantom line F and is parallel to the swinging and rotational axes of the cutter 25. A pair of feed rollers 29 driven by hydraulic motors and movable towards and away from one another transversely of the feed path F feed the tree longitudinally through the processing assembly.

If the trees in the storage 11 are unlimbed, the cutting is preceded by a delimbing operation carried out by means of a delimber having a pair of blades 30 movable towards and away from the feed path F of the tree.

Moreover, the processing procedure may comprise cutting off of the top of the tree. Such cutting is carried out by means of a hydraulically driven chain saw 31 (FIG. 1) which is swingable between an inoperative position and an operative position in the same manner as the circular saw cutter 25.

On the processing assembly 24 there is also provided a measuring roller 32 which is rotatably mounted on a support arm 33. The arm 33 is swingable about an axis parallel to the feed path F between an inoperative position and an operative position in which the measuring roller is in frictional driving engagement with the tree. The rotation of the measuring roller about an axis transverse to the feed path F is converted into a measuring signal representative of the length of the portion of the tree fed past the cutter 25.

Figure 2:
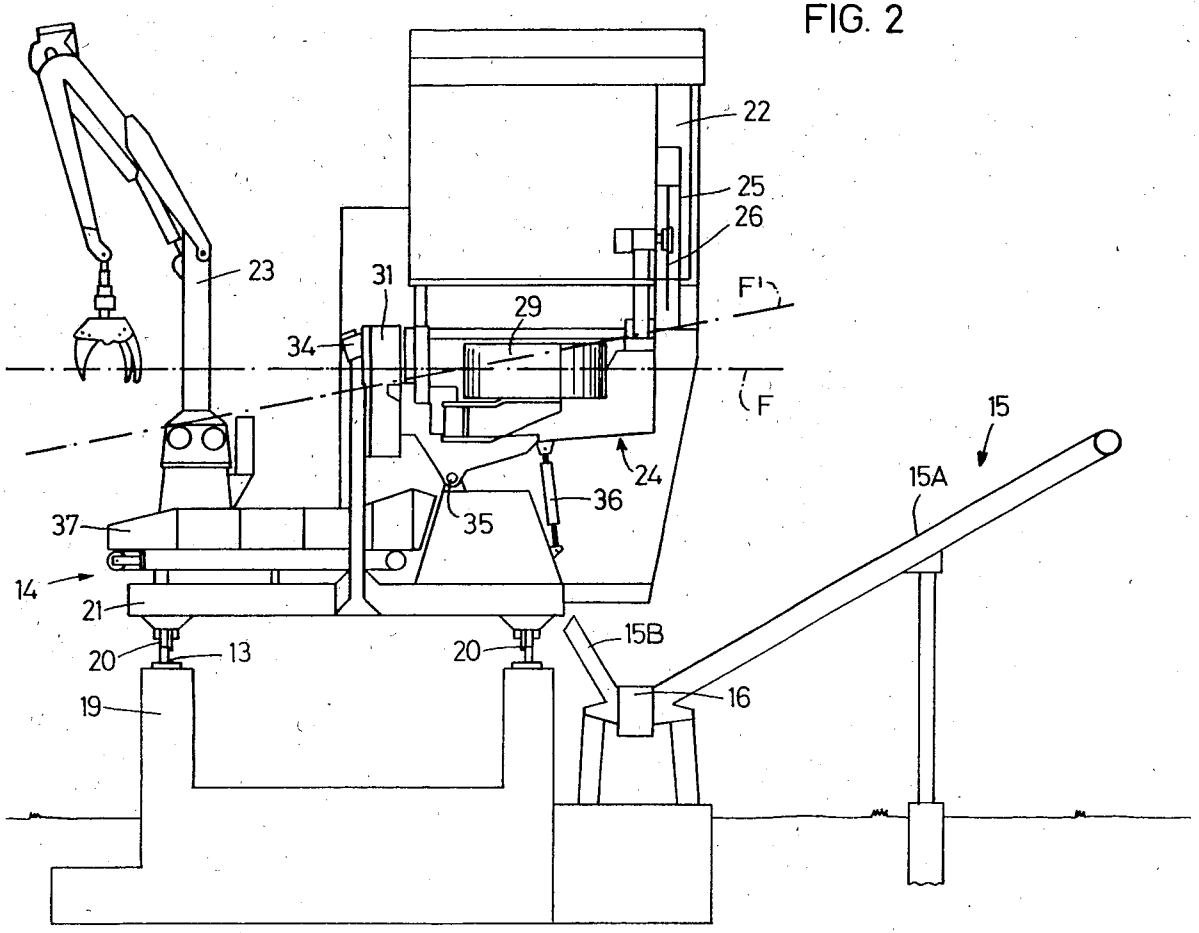
FIG. 2 is a diagrammatic end view of a processing unit with an associated track and with an associated log receiving bed, both forming part of the processing installation.
Figure 3:
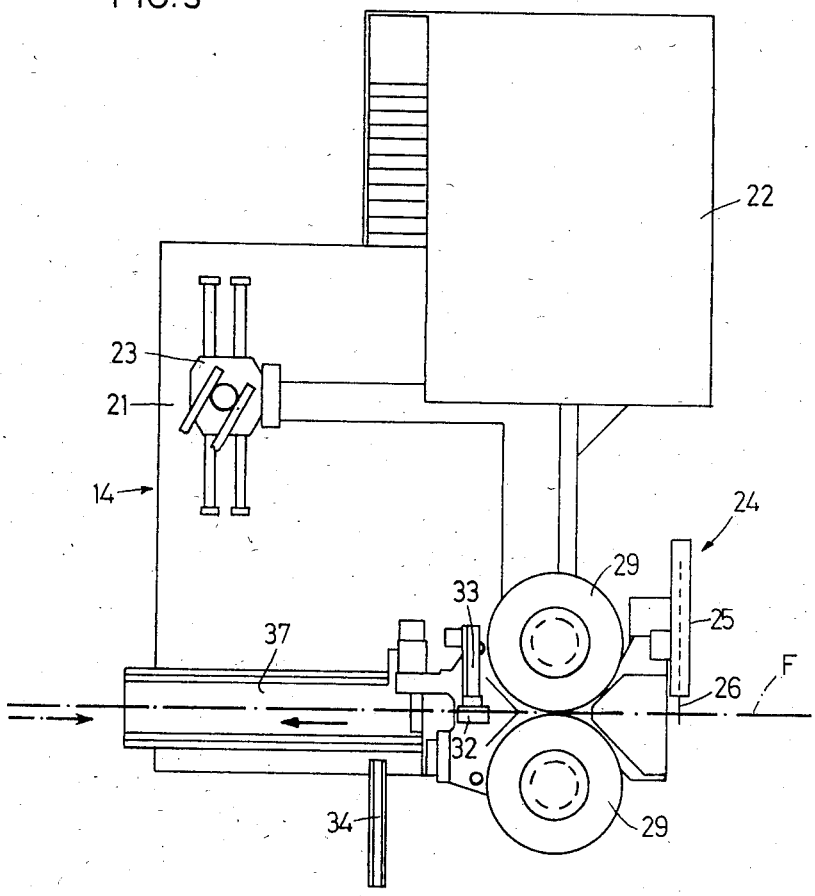
FIG. 3 is a plan view of the processing unit shown in FIG. 2.

The entire processing assembly 24 is tiltable about a horizontal axis 35 transverse to the feed path F of the tree (FIG. 2). The angle of tilt and, accordingly, the inclination of the feed path F to the horizontal plane, may be adjusted by the operator by means of two hydraulic cylinders 36 (only one of them is shown in the drawings, see FIG. 2).

On the platform, adjacent the processing assembly 24 there is also a short horizontal transverse conveyor 34 disposed at a level slightly higher than the feed path F. This transverse conveyor can be used as a support for the butt end of a tree waiting for a tree already being processed to be discharged from the processing assembly. By means of the transverse conveyor the butt end of the supported tree may then be moved inwardly towards the feed path F until it drops between the feed rollers 29.

At the infeed side of the processing assembly 24, that is, the side near the storage 11, a horizontal conveyor 37 is provided immediately below the feed path F. This conveyor serves to collecting limbs, tops and other waste material falling from the trees during the processing and to discharging such waste from the platform 21 towards the storage 11.

The log receiving bed 15 forms an inclined plane 15A which is rectangular in plan view and has longitudinal horizontal edges parallel to the track 13. The longitudinal edge nearest the track is approximately directly below the circular saw cutter 25. At that edge, the inclined plane of the log receiving bed merges with the plane of the horizontal conveyor 16. At the side of the horizontal conveyor 16 nearest the track 13, the bed has an upwardly inclined portion 15B. The opposite longitudinal edge of the inclined plane 15A is at a higher level than the first-mentioned longitudinal edge, namely, slightly below the level of the feed path F when the latter is horizontal as shown in FIG. 2.

When trees are being processed, the operator moves the processing unit 14 along the track 13 until the tree which it is desired to process is within reach of the crane 23. By means of the crane the operator picks and brings up the tree, the butt end of which is placed between the feed rollers 29, if required after a period of waiting on the transverse conveyor 34. If required, the angle of tilt of the processing assembly is adjusted such that the feed path F is at least approximately parallel to the tree, the top end of which is resting on the ground or on underlying trees in the storage 11. An example of a tilted position of the feed path is indicated by a phantom line F' in FIG. 2.

The feed rollers 29 then advance the tree longitudinally through the processing assembly. Any limbs of the tree are removed as the tree is being advanced. The movement of the butt end past a sensing point is registered electro-optically and signalled to a measuring system (not shown) which ascertains the position of the butt end relative to the circular saw cutter using impulses from an impulse generator driven by the measuring roller. When the length of the cantilevered portion of the tree extending beyond the circular saw cutter is equal to the desired log length, the circular saw cutter is actuated to cut off the tree very rapidly.

The cut tree portion, the log, drops onto the receiving bed and slides, small end foremost, down to the horizontal conveyor 16. The horizontal conveyor moves the small end of the log towards the sorting installation 17 while the butt end slides or rolls down towards the conveyor. Thus, the log is caused to be parallel with the track 13 and to be forwarded with the small end foremost to the sorting installation 17 where it is discharged into an appropriate section.

The processing then is continued in that the tree is further advanced a length corresponding to the desired length of the next log. If the top of the tree remains, it is cut off by means of the chain saw 31 before the last log is discharged from the processing assembly.

In the embodiment described above the receiving bed 15 is stationary and extends substantially over the entire range of operation of the processing unit. However, it is within the scope of the invention to mount the log receiving bed on the processing unit 14 and transfer the parallelized and unidirectionalized logs to a separate underlying conveyor or allow them to drop to the ground. In such case the logs may be caused to be unidirectionalized in that the inclined bed plane is inclined not only transversely as in FIG. 2 but also longitudinally.

I claim:

1. An installation for processing trees in a terminal landing, comprising a processing unit movable on a horizontal track and including a loading crane for picking trees from a storage adjacent the track, a processing assembly on said processing unit having a feeder for receiving the butt end of trees supplied by means of the loading crane and for advancing the trees lengthwise toward a cutter on said processing assembly for cutting the trees to logs with the trees cantilevered between the butt end and the cutting site, a log-received bed positioned beneath the processing assembly at the discharge side of said cutter and forming an inclined plane, said log-receiving bed having at its lower side a horizontal conveyor running parallel with the track of said processing unit, and a transverse conveyor mounted adjacent to, and slightly higher than, said feeder for temporarily supporting the butt end of a tree to be processed, said transverse conveyor being adapted to move the butt end of the tree to a position for reception thereof by said feeder.

2. An installation according to claim 1, said log receiving bed is stationary.

3. An installation according to claim 2, said horizontal conveyor being positioned substantially vertically below the cutter of said processing assembly.

4. An installation according to claim 2, said the processing assembly being tiltable about a horizontal axis parallel with the track of said processing unit.

5. An installation according to claim 1, said horizontal conveyor being positioned substantially vertically below the cutter of said processing assembly.

6. An installation according to claim 5, said the processing assembly being tiltable about a horizontal axis parallel with the track of said processing unit.

7. An installation according to claim 1, said processing assembly being tiltable about a horizontal axis parallel with the track of said processing unit.

* * * * *